US008235660B2

(12) United States Patent
Hort et al.

(10) Patent No.: US 8,235,660 B2
(45) Date of Patent: Aug. 7, 2012

(54) FAN, ESPECIALLY A CEILING FAN WITH A BALANCED SINGLE BLADE

(75) Inventors: Michael J. Hort, Chatswood (AU); Daniel Gasser, Tamarama (AU); John M. Levey, Bondi (AU)

(73) Assignees: Michael John Hort, Chatswood, New South Wales (AU); Daniel Gasser, Tamarama, New South Wales (AU)

( * ) Notice: Subject to any disclaimer, the term of this patent is extended or adjusted under 35 U.S.C. 154(b) by 0 days.

(21) Appl. No.: 12/803,834

(22) Filed: Jul. 6, 2010

(65) Prior Publication Data

US 2010/0278646 A1 Nov. 4, 2010

Related U.S. Application Data

(63) Continuation of application No. 10/592,161, filed as application No. PCT/AU2005/000316 on Mar. 8, 2005, now abandoned.

(30) Foreign Application Priority Data

Mar. 8, 2004 (AU) ..... 2004901170

(51) Int. Cl.
*F01D 5/10* (2006.01)

(52) U.S. Cl. ..... 416/19; 416/144; 416/145; 416/205

(58) Field of Classification Search ..... 416/19, 416/144, 145, 205
See application file for complete search history.

(56) References Cited

U.S. PATENT DOCUMENTS

| | | | |
|---|---|---|---|
| 2,079,044 | A | 5/1937 | Santmyer |
| 2,129,939 | A | 9/1938 | Juul |
| 2,837,307 | A | 6/1958 | Jenney |
| 3,693,910 | A | 9/1972 | Aldi |
| 4,132,360 | A | 1/1979 | Lee, Jr. |
| 4,148,594 | A | 4/1979 | Stafford |
| 4,776,761 | A | 10/1988 | Diaz |
| D306,643 | S | 3/1990 | Taylor, III |
| D313,467 | S | 1/1991 | Frampton |
| D325,436 | S | 4/1992 | Taylor, III |
| D325,778 | S | 4/1992 | Taylor, III |
| D326,149 | S | 5/1992 | Taylor, III |
| D329,285 | S | 9/1992 | Taylor, III |

(Continued)

FOREIGN PATENT DOCUMENTS

| | | |
|---|---|---|
| AU | 152772 | 8/1983 |

(Continued)

OTHER PUBLICATIONS

Australian Trademark Application No. 936631. filed on Dec. 5, 2002.

(Continued)

*Primary Examiner* — Igor Kershteyn
(74) *Attorney, Agent, or Firm* — TraskBritt

(57) ABSTRACT

Described is a fan with a blade suitable for use as a ceiling fan. The blade may be regarded as a single blade, although shaft is not attached to blade at one end thereof; rather, shaft is attached to blade at a point between first end and second end. Blade is balanced by counterweights located in blade. In one embodiment, blade is connected to shaft by means that permit angular movement, such as a teeter hinge.

3 Claims, 7 Drawing Sheets

U.S. PATENT DOCUMENTS

| | | | | |
|---|---|---|---|---|
| D329,286 | S | 9/1992 | Taylor, III | |
| D329,896 | S | 9/1992 | Taylor, III | |
| D336,513 | S | 6/1993 | Junkin et al. | |
| D341,419 | S | 11/1993 | Taylor, III | |
| 5,439,352 | A | 8/1995 | Line | |
| 5,462,462 | A | 10/1995 | Woodley | |
| 5,988,978 | A | 11/1999 | Pearce | |
| D424,190 | S | 5/2000 | Tang | |
| D432,640 | S | 10/2000 | Frampton | |
| D433,118 | S | 10/2000 | Frampton | |
| D433,119 | S | 10/2000 | Frampton | |
| D433,498 | S | 11/2000 | Frampton | |
| D433,747 | S | 11/2000 | Frampton | |
| D433,748 | S | 11/2000 | Frampton | |
| D433,749 | S | 11/2000 | Frampton | |
| D434,134 | S | 11/2000 | Frampton | |
| D437,047 | S | 1/2001 | Frampton | |
| D437,406 | S | 2/2001 | Frampton | |
| D438,610 | S | 3/2001 | Frampton | |
| D438,950 | S | 3/2001 | Frampton | |
| D443,926 | S | 6/2001 | Frampton | |
| D444,553 | S | 7/2001 | Frampton | |
| 6,309,083 | B1 | 10/2001 | Lathrop et al. | |
| D450,380 | S | 11/2001 | Frampton | |
| D451,997 | S | 12/2001 | Schwartz | |
| D454,192 | S | 3/2002 | Frampton | |
| D454,634 | S | 3/2002 | Frampton | |
| D454,635 | S | 3/2002 | Frampton | |
| 6,352,407 | B2 * | 3/2002 | Hill et al. | 416/144 |
| D456,073 | S | 4/2002 | Frampton | |
| D457,620 | S | 5/2002 | Frampton | |
| D460,817 | S | 7/2002 | Frampton | |
| D461,888 | S | 8/2002 | Frampton | |
| 6,428,188 | B1 | 8/2002 | Magno, Jr. et al. | |
| D466,207 | S | 11/2002 | Frampton | |
| D467,327 | S | 12/2002 | Frampton | |
| D478,981 | S | 8/2003 | Frampton | |
| D480,135 | S | 9/2003 | Frampton | |
| D480,802 | S | 10/2003 | Frampton | |
| D480,803 | S | 10/2003 | Frampton | |
| D483,108 | S | 12/2003 | Frampton | |
| D485,350 | S | 1/2004 | Frampton | |
| D485,351 | S | 1/2004 | Frampton | |
| 6,685,436 | B2 | 2/2004 | Huang | |
| D487,508 | S | 3/2004 | Frampton | |
| D487,509 | S | 3/2004 | Frampton | |
| D488,219 | S | 4/2004 | Frampton | |
| D488,220 | S | 4/2004 | Frampton | |
| D488,221 | S | 4/2004 | Frampton | |
| D488,222 | S | 4/2004 | Frampton | |
| D488,223 | S | 4/2004 | Frampton | |
| D488,224 | S | 4/2004 | Frampton | |
| D489,128 | S | 4/2004 | Frampton | |
| 6,726,451 | B2 | 4/2004 | Frampton | |
| D506,826 | S | 6/2005 | Frampton | |
| D535,388 | S | 1/2007 | Gajewski | |
| D536,087 | S | 1/2007 | Pickett | |
| 7,217,082 | B2 | 5/2007 | Frampton et al. | |
| D571,455 | S | 6/2008 | Hort et al. | |
| 2001/0043863 | A1 | 11/2001 | Hill et al. | |
| 2003/0129057 | A1 | 7/2003 | Frampton | |
| 2004/0141842 | A1 | 7/2004 | Frampton | |

FOREIGN PATENT DOCUMENTS

| | | | |
|---|---|---|---|
| AU | 133424 | S | 4/1998 |
| FR | 2567844 | | 7/1984 |
| WO | WO 2005/085649 | | 9/2005 |

OTHER PUBLICATIONS

PCT International Search Report. PCT/AU2005/00316 dated May 27, 2005.

PCT International Preliminary Report on Patentability, PCT/AU2005/00316 dated Jun. 21, 2006.

"Sycamore Ceiling Fan", promotional piece brochure, date unknown (at least as early as Apr. 27, 2004). US.

"Sycamore Ceiling Fan," promotional piece brochure with photograph of sycamore seed, published prior to 2001.

Sycamore Ceiling Fan, Nature+Technology <http://www.sycamorefan.com>, visited Jul. 13, 2007.

Sycamore Ceiling Fan, Nature+Technology, Features <http://www.sycamorefan.com/fan/feature/features.html>, visited Jul. 13, 2007.

Fanimation. "Unique Ceiling, Wall & Floor Mounted Fans," catalog, Jan. 1990, USA.

Clem Labine's Traditional Building, "A Fan-tastic Ceiling Accessory," magazine article, Nov./Dec. 1997, USA.

Architectural Antiques—Andy Thornton, "Fan Systems," Catalog No. 12, First Edition, Mar. 1994. USA.

Gumps Mail Interiors. Plantation Ceiling Fan, catalog, Jul. 1998, USA.

The Sharper Image Home Collection, Plantation Ceiling Fan, catalog, Summer 1998, USA.

American Homestyle & Gardening. "The Islander Fan," magazine article, Aug./Sep. 1995, USA.

Metropolitan Home, "Three-Leaf Palm Fan by Fanimation," magazine article. Jul./Aug. 1998, USA.

A-Plus: Art/Antiques/Design—Cape Cod Edition, "Keep Your Cool," News Article, Jun. 1998. USA.

Friedes Associates. "1997 Hudson River Showhouse, New York," promotional piece, specific date unknown. USA.

Photograph—author unknown, Dec. 3. 1995, Raffles Hotel, Singapore.

Photograph—author unknown, circa 1905, White Rabbit Saloon. Tennessee.

Fanimation, "The Islander," promotional piece, date unknown (at least as early as Apr. 27, 2004). USA.

Fanimation, "The Palisade," promotional piece, date unknown (at least as early as Apr. 27. 2004). USA.

Winnower Fan Co. Inc., advertising brochure, p. 20, Ceiling Fan A.

Fanimation, "Unique Ceiling, Wall & Floor Mounted Fans," catalog. Jan. 2000, USA.

Emerson, "Ceiling Fans Research & Development" catalog. Jan. 2001. USA.

Publication Unknown, "The Rhinoceros Club," newspaper, date unknown (at least as early as Apr. 27, 2004). USA.

"Hampton Bay," promotional piece, date unknown, USA.

The Beacon, "Neon is a gas: local firm produces signs, architectural lighting," Newspaper Article, Aug. 1998. USA.

NICOR Advertisement. Sep. 2000 issue, USA.

NICOR website: <www.nicorlighting.com>, Jul. 5, 2002. various ceiling fan photographs.

Regency Ceiling Fans, "Tropic Air" promotional piece brochure, Copyright 2001, USA.

Furniture Style, "Tahitian Ceiling Fan," magazine article. CONCORD product advertisement. Dec. 2001, USA.

Home Lighting & Accessories, "Vintage Crown Collection." magazine article, CONCORD product advertisement, Dec. 2001, USA.

Fanimation. "Unique Ceiling, Wall, & Floor Fans." catalog, Jan. 2002, USA.

* cited by examiner

FAN, ESPECIALLY A CEILING FAN WITH A BALANCED SINGLE BLADE

CROSS-REFERENCE TO RELATED APPLICATIONS

This is a continuation of U.S. Ser. No. 10/592,161, which is a national phase entry under 35 U.S.C. §371 of International Patent Application PCT/AU2005/000316, filed Mar. 8, 2005, filed Dec. 14, 2006 now abandoned published in English as International Patent Publication WO 2005/085649 A1 on Sep. 15, 2005, which claims the benefit under 35 U.S.C. §119 of Australian Patent Application No. 2004901170, filed Mar. 8, 2004, the contents of the entirety of each of which are hereby incorporated by this reference.

TECHNICAL FIELD

The present invention relates to fans and, in particular, to a ceiling fan that is balanced. The invention is particularly directed to the type of ceiling fan that may be regarded as having a single blade.

BACKGROUND

Single blade ceiling fans are desirable because, potentially, they may produce less drag, thereby increasing the efficiency of the fan, providing greater air flow at lower rotational speeds. Another potential advantage with a single blade is that the weight of the fan may be reduced, thus allowing the span of the blade to be of a larger dimension, compared to a conventional blade for a multi-bladed fan.

However, there have been problems in balancing single-bladed fans. Counterweights have been applied to the shaft of the fan or opposite the mass of the blade. An attempt to address the problem has been made in U.S. Pat. No. 6,726,451, where the ceiling fan blade mounting arrangement produces a center of rotational gravity disadvantageously lying outside the vertical axis of the rotating fan.

It is desirable to provide a ceiling fan that can be balanced both statically and dynamically for stabilized rotation at high and low rotational speeds. Moreover, it is desirable to provide a ceiling fan that can be an architectural feature and be aesthetically pleasing. Furthermore, it would be desirable to provide a single-bladed fan having a blade similar to the shape of a sycamore seed pod and, thus, may have a sculptured shape, which may be appreciated even when the fan is not in use. Lastly, it is also desirable to provide a blade having a shape with aerodynamic advantages compared to the shape of a conventional blade.

BRIEF SUMMARY OF THE INVENTION

Accordingly, provided is a fan including a blade having a first end, a second end, a leading edge and a trailing edge, the blade being rotatable by a shaft connected to a motor, wherein the blade is balanced by counterweight, at least some of which is located in the blade.

The fan of the invention is a ceiling fan.

The invention also provides a blade for a fan, the blade having a first end, a second end, a leading edge and a trailing edge, the blade being adapted for rotation by a shaft connected to a motor, wherein the blade includes counterweight.

In one aspect, the blade may be constructed of any suitable material. The material may be a solid low density material or a high density material, such as metal, polymer or wood. The blade may be made from a thin rigid skin filled with foam reinforcing, such as self-skinning polyurethane. Optionally, the fan is made by extrusion blow molding or reaction injection molding or other suitable technique, such as metal casting.

In another aspect, the blade is an irregular sculptured form. Specifically, the blade takes the form of or is adapted from the shape of a sycamore seed pod. The blades in the drawings (discussed below) are adapted from the shape of a sycamore seed pod. Such a blade is not flat as many conventional fan blades are, but includes curves and contours.

In one embodiment, the blade has an aerofoil cross section, with varying vertical thickness from the leading edge to the trailing edge. The aerofoil part of the blade is designed to create less turbulence and drag in its wake. It may require less energy to rotate it about its vertical axis compared to a conventional flat blade and it may also create less wind noise. The aerofoil design may also create higher airflow at lower speeds, compared to conventional ceiling fans.

The blade may be wider than many conventional fan blades. At low speed, a longer chord length aerofoil section is more efficient. The first and second ends are shaped to be curved, preferably elliptical. It is known that aircraft wings with elliptical wing tips (in plan view) produce less turbulence than square-ended wing tips at low speed.

In this embodiment, the blade is not linear in plan view but is angled. In one configuration, there is an angle of approximately 170 degrees between the first end and the second end.

The shaft and the motor may be of any suitable shape or arrangement. The blade is attached to the shaft at a connection point located between the first end and the second end. Optionally, the connection point is closer to the second end than to the first end. The blade is bent so that there is an angle of approximately 170 degrees between the first end and the second end, providing the connection point at or proximately located at the angle of bend.

It will be appreciated that the blade of the fan of the invention may be regarded as a single blade and allowing the connection point to be located between the first end and the second end, being closer to the second end than to the first end, the whole blade being a single unit. In yet another aspect, the portion of the blade from the connection point to the first end may be regarded as the primary blade and the portion of the blade from the connection point to the second end may be regarded as a pod, in view of the similarity to a sycamore seed pod. The pod has its leading edge higher than its trailing edge. The pod may not contribute greatly to air flow provided by the fan of the invention. However, the pod may provide aerodynamic lift that can partially balance aerodynamic lift created by the primary blade. In addition, the pod, as illustrated in the drawings, may be designed to create minimum turbulence in its wake in order to minimize the energy required to overcome its aerodynamic drag.

The organic form shape, profile and relative orientation of the primary blade and pod of the blade of the invention in this embodiment have been designed to allow the incorporation of at least one counterweight within the form of the blade. The purpose of this is to avoid interruption of the continuous sculptural surface of the blade of the invention while allowing the position of the center of gravity of the blade to be located within the blade.

Also, the blade of the invention has been designed so that incorporation of at least one counterweight in the pod causes the center of mass of the blade of the invention to lie at a point within the blade in the top plan view. In addition, the position and mass of the counterweight may be adjusted to ensure that the combined center of mass of the blade of the invention and the counterweight is located on the vertical axis of rotation of the blade of the invention.

In another embodiment, the blade is connected to the shaft and adapted to permit angular movement of the blade relative to the shaft. Optionally, the connection includes or comprises the type of hinge known as a teeter hinge.

Optionally, the center of mass of the blade of the invention and the counterweight is located within the body of the blade of the invention, when the blade is viewed in front elevation. The shape, profile and relative orientation of the primary blade and pod may be determined to ensure that the center of mass is sufficiently far within the blade form to allow all the components required to permit angular movement of the blade relative to the shaft to be located within the blade without compromising the sculptural integrity of the blade form.

The counterweight includes at least one discrete mass of material. The counterweight may comprise two or more discrete masses of such material. The counterweight may be located in the blade. Alternately, some of the counterweight may be located in the blade and some elsewhere such as on the shaft. The material of one discrete mass may be the same as or different from the material of another discrete mass in the same fan. The counterweight is made of a material having a mass greater than that of the material of the blade. Optionally, the counterweight is made of a material having a mass lesser than that of the material of the blade. Furthermore, the counterweight is provided by increasing wall thickness within the blade, for example, during manufacture. In this regard, the blade may be manufactured by extrusion blow molding. During manufacture, the wall thickness of selected parts of the blade may be increased in order to provide all or some of the counterweight.

In a further embodiment, a blade may be molded in two halves, such as top and bottom, by a reaction injection molding process or other suitable technique, such as metal casting including aluminum or magnesium, fiberglass layup or wood shaping, with different, varying wall sections as required to provide some or all of the counterweight, prior to joining the two halves to create the complete blade.

Optionally, the location of at least one of the counterweights is adjustable, so that compensation can be made for manufacturing tolerances. Furthermore, additional counterweights may also be added to the fan of the invention for tuning the balance during manufacture. In this regard, counterweights may be located under a removable cover on the blade. The same cover can cover a cavity into which some or all of the counterweight may be inserted. Such a cover may be sculpted to match the surface form of the blade or may be a simple flat or round infill on the top surface of the blade.

Of course, any counterweights located in the blade may be assembled into a pocket in the exterior of the blade (with or without a cover) or molded into the surface of the blade (with or without a cover).

Where all the counterweights are not located in the blade, it is beneficial to mount the counterweights on the shaft.

Furthermore, the counterweights may be located along the leading edge of the blade. Part of the counterweights being located along the leading edge and part along the trailing edge of the blade.

BRIEF DESCRIPTION OF THE DRAWINGS

The drawings illustrate what is currently considered to be the best mode for carrying out the invention.

DETAILED DESCRIPTION OF THE INVENTION

Figure 1:
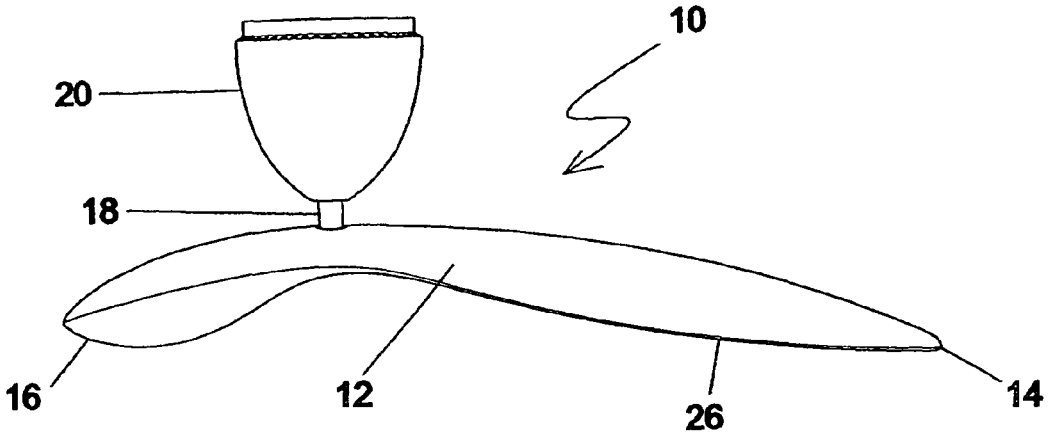
FIG. 1 is a side elevation of a first embodiment of a ceiling fan, viewed from the trailing edge.

Referring first to FIG. 1, ceiling fan 10 has a blade 12 that can be regarded as a single blade having first end 14 and second end 16. Blade 12 is sculptured in a form similar to that of a sycamore seed pod. It is curved and designed to provide a downward draught when it rotates clockwise (as viewed from above).

Blade 12 is rotatable by a shaft 18, connected to an electric motor (not shown) within motor cover 20.

Figure 2:
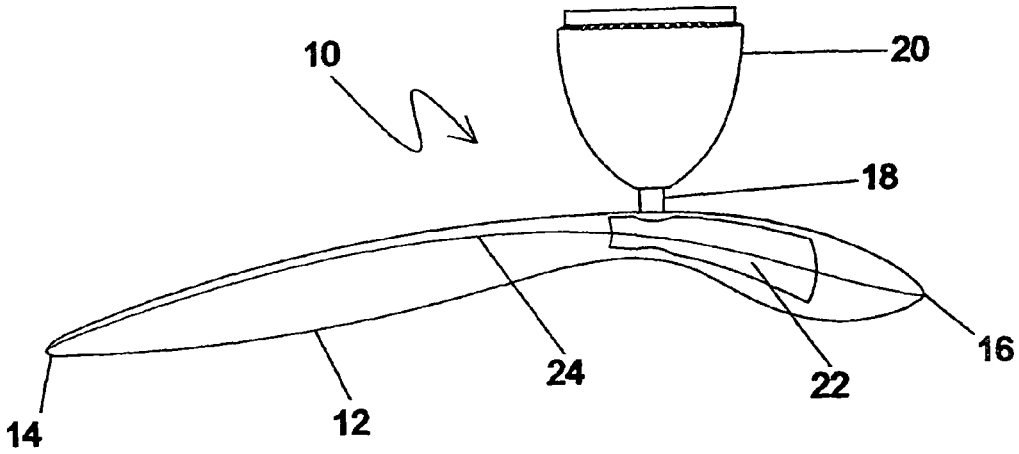
FIG. 2 is a side elevation of the fan of FIG. 1, viewed from the leading edge.

As can be seen from FIGS. 1 and 2, blade 12 is irregular in shape and is fixed to shaft 18 closer to second end 16 than to first end 14.

In this embodiment, the counterweight is comprised of a balancing weight 22 located along leading edge 24 of the primary blade (that part between shaft 18 and first end 14) and along the trailing edge of the pod (that part between shaft 18 and second end 16) and close to second end 16. Balancing weight 22 is made from a material that is of greater density than the material of blade 12. Weight 22 comprises a single discrete mass and is molded to follow the contours of blade 12 so that it is unobtrusive.

Because there is no counterweight attached to shaft 18, motor cover 20 does not need to be enlarged to accommodate any such weight and, indeed, may be somewhat smaller than that illustrated.

Figure 3:
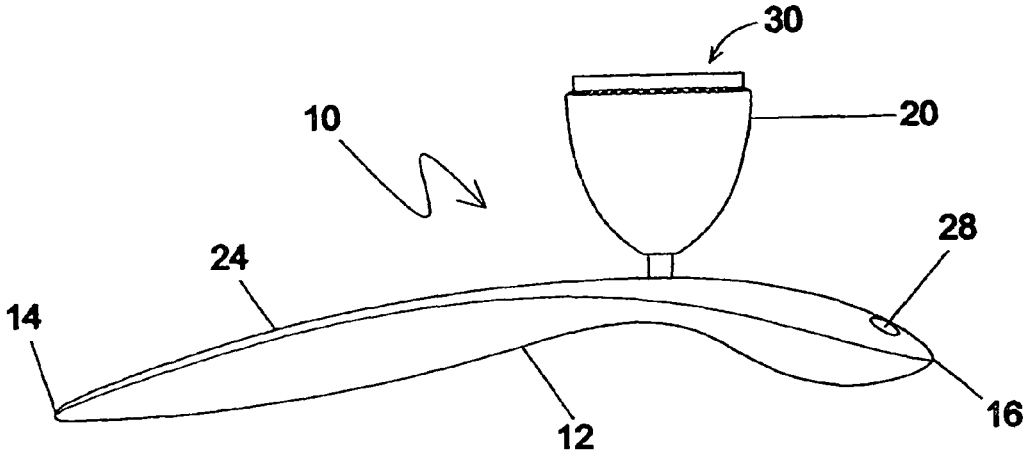
FIG. 3 is a side elevation of a second embodiment of the fan, viewed from the leading edge.

FIG. 3 shows a similar embodiment to the embodiment in FIGS. 1 and 2 and the same numbers are used for the same parts as in FIGS. 1 and 2. In the FIG. 3 embodiment, a counterweight 28 is located in blade 12 very close to second end 16. In this embodiment, however, weight 28 is somewhat smaller in mass than weight 22 of FIG. 2. There is a second discrete weight 30 (not visible in the figure) attached to shaft 18. The combination of the weights 28 and 30 balances blade 12 when rotating.

If desired, weight 30 on shaft 18 could be divided into two masses and distributed around shaft 18.

Figure 4:
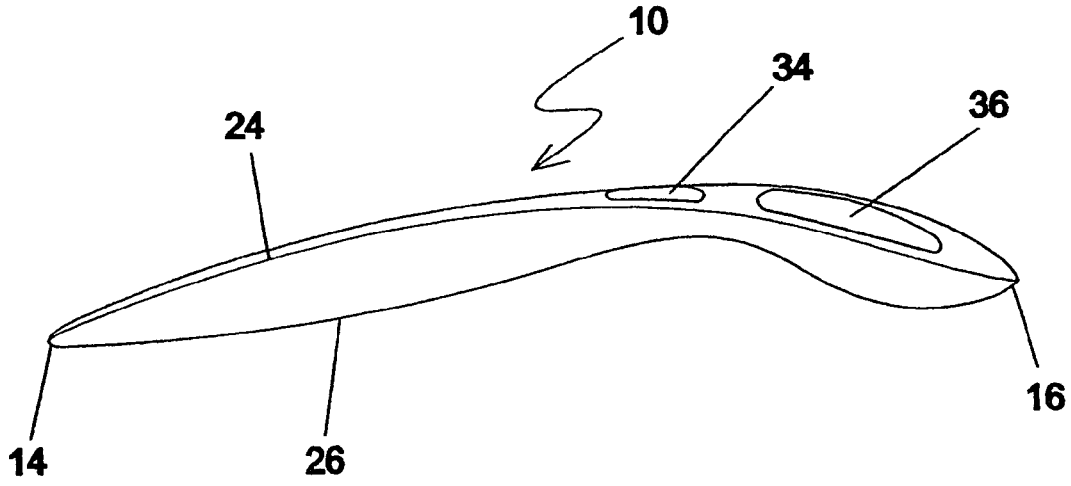
FIG. 4 is a side elevation of a blade for a further embodiment of a ceiling fan, viewed from the leading edge.
Figure 5:
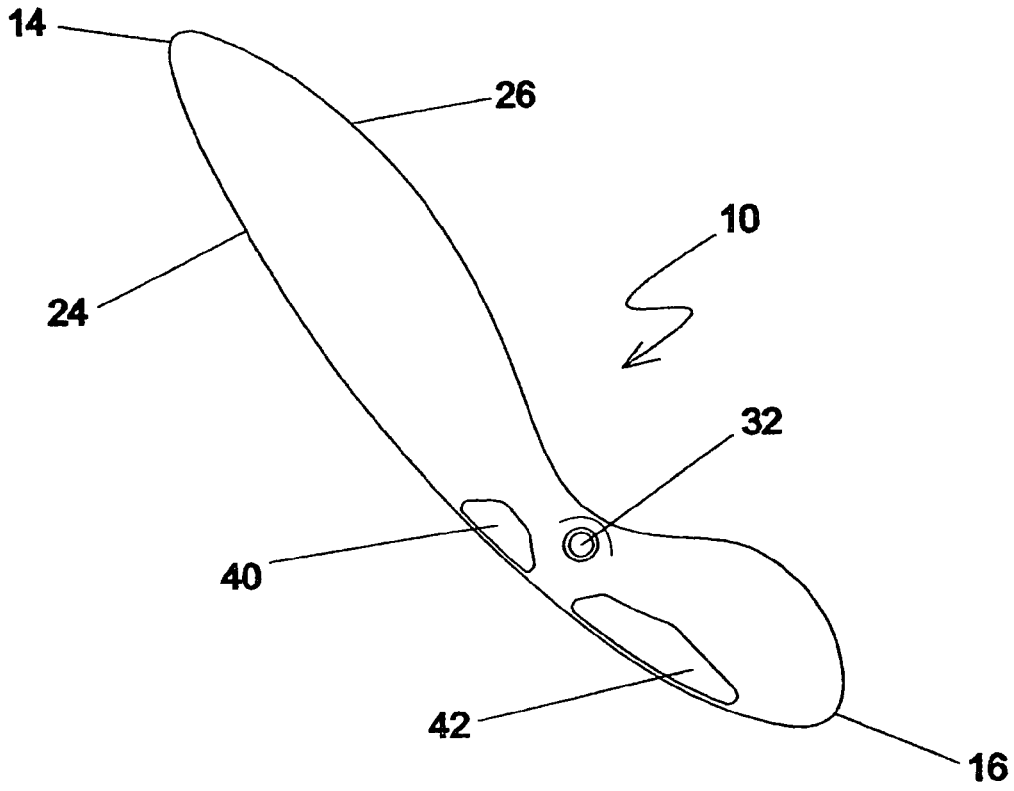
FIG. 5 is a top plan view of the blade of FIG. 4.
Figure 6:
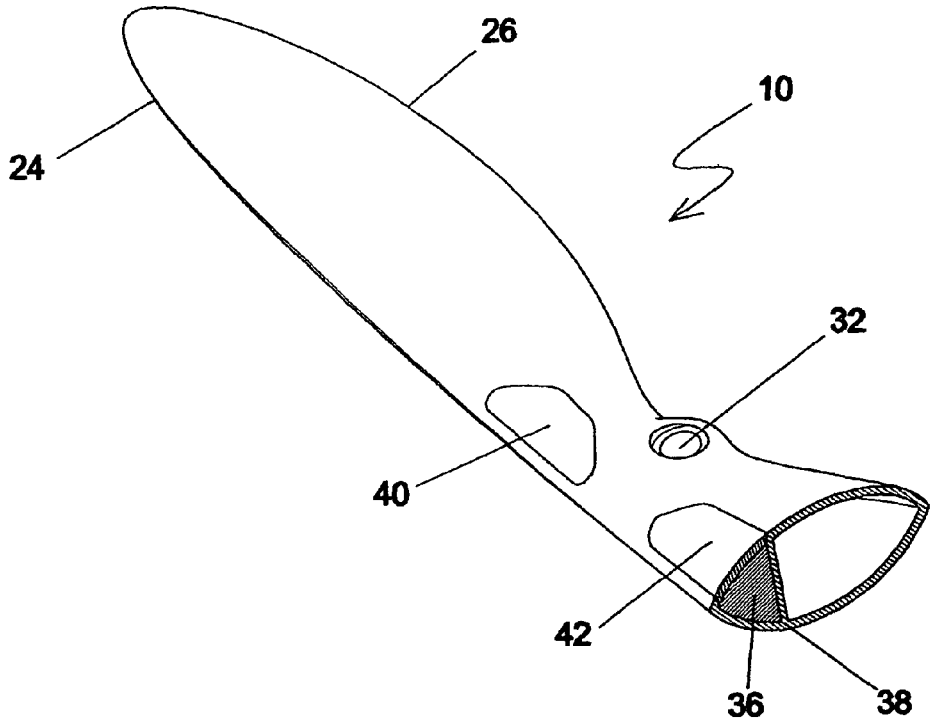
FIG. 6 is a perspective view of the blade of FIGS. 4 and 5, cut away at the second end to show internal construction.

Referring now to FIGS. 4, 5 and 6, although this is a different embodiment from the embodiment of FIGS. 1 and 2 and the embodiment of FIG. 3, the same part numbers will be used where the parts are the same or very similar. In this embodiment, blade 12 has substantially elliptical first end 14, substantially elliptical second end 16, leading edge 24 and trailing edge 26. As shown by the plan view of FIG. 5, blade 12 is curved at leading edge 24 and there is an angle of approximately 170° between first end 14 and second end 16. Located at approximately the bend point is connection point 32. In this embodiment, connection point 32 is a circular aperture adapted to receive shaft 18 (not shown). Connection point 32 may be of any other suitable shape.

Blade 12 includes two discrete masses by way of counterweight means, first mass 34 and second mass 36. Each of masses 34 and 36 is inserted within blade 12. Part of second mass 36 can be seen in FIG. 6, inserted in cavity 38. Cover 40 covers first mass 34 and cover 42 covers second mass 36. Each of covers 40 and 42 is removable, so that the mass in the underlying cavity may be removed or changed as appropriate.

It will also be noted from FIG. 6 that blade 12 is generally hollow, being made of thermoplastic polymer material, such as ABS or high density polyethylene.

Figure 7:
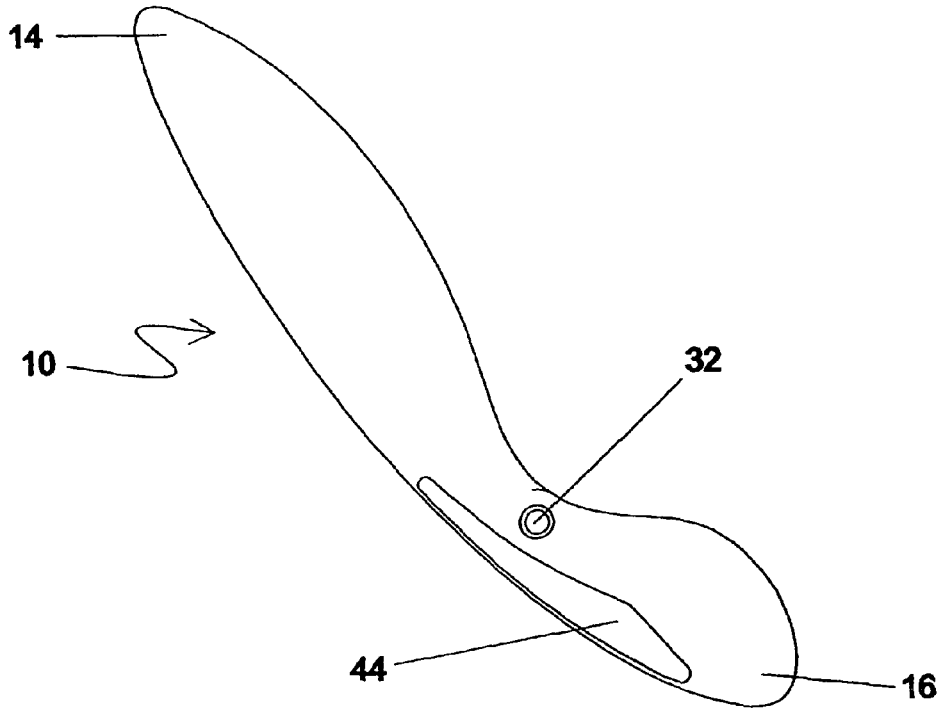
FIG. 7 is a top plan view of a further embodiment of a blade.

The embodiment in FIG. 7 is similar to that in FIGS. 4, 5 and 6, except that first mass 34 and second mass 36 are replaced by a single mass 44.

Figure 8:
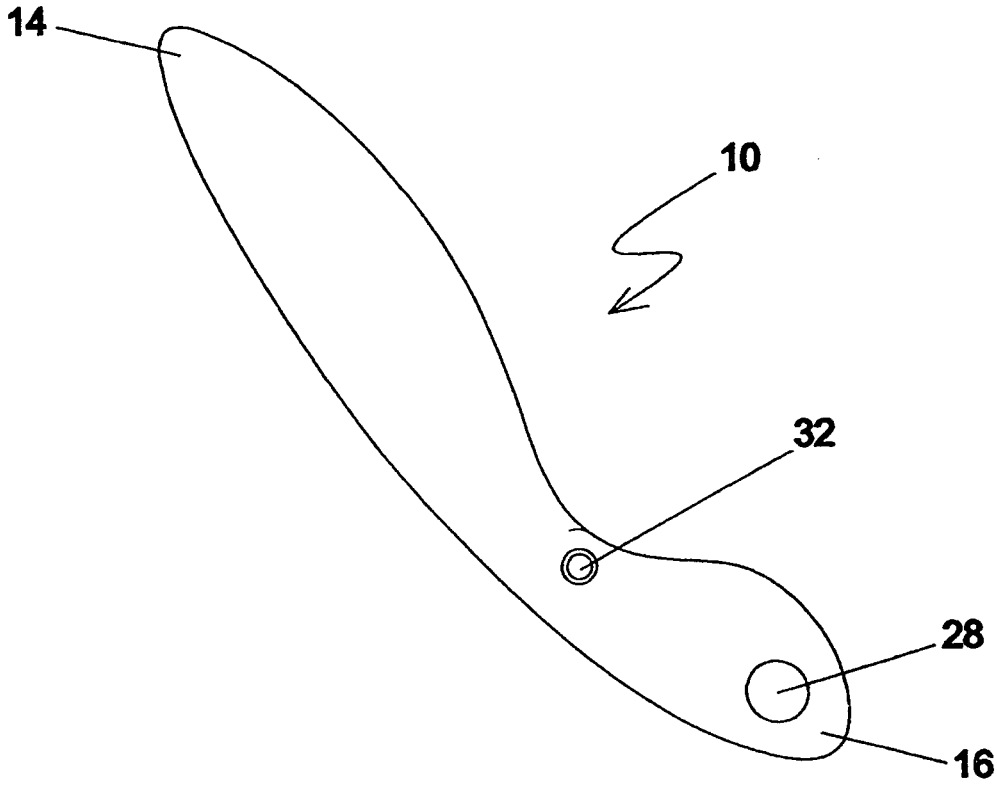
FIG. 8 is a top plan view of the second embodiment of a blade of FIG. 3.

The FIG. 8 embodiment shows in top plan view the embodiment discussed above in connection with FIG. 3.

Figure 9:
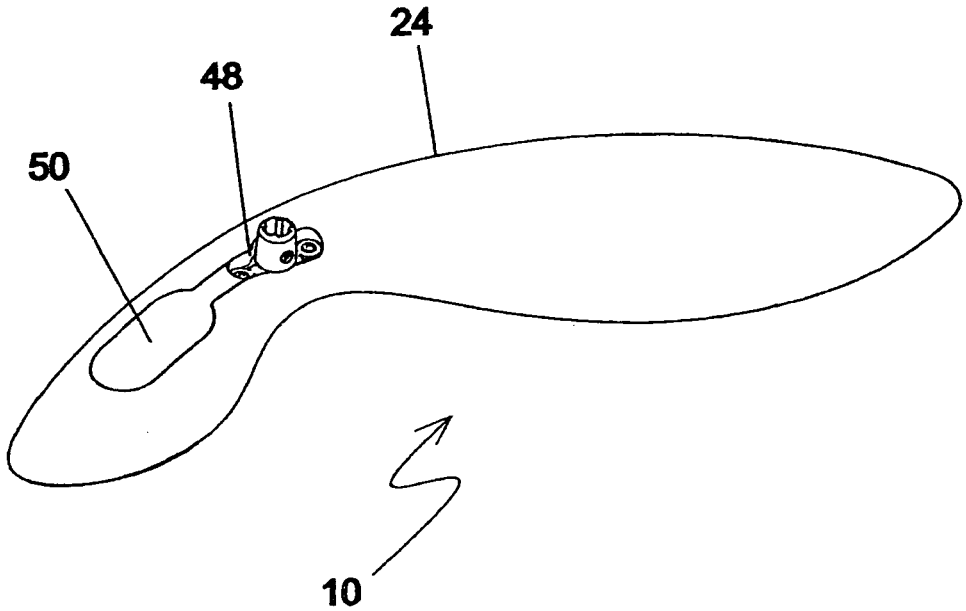
FIG. 9 is a perspective view of a further embodiment of a blade that includes a teeter hinge.
Figure 10:
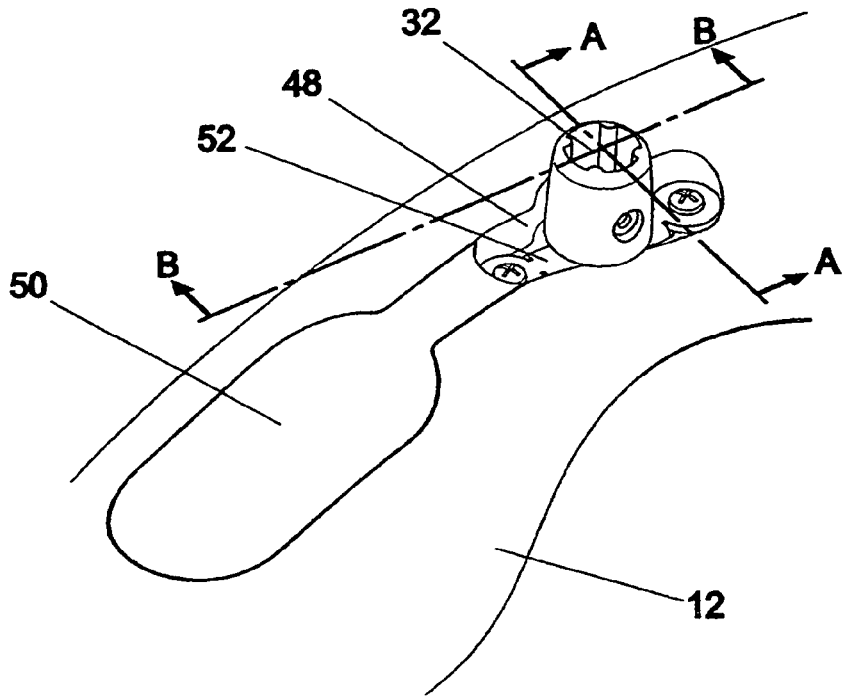
FIG. 10 shows the connection point and part of the teeter hinge of FIG. 9.
Figure 11:
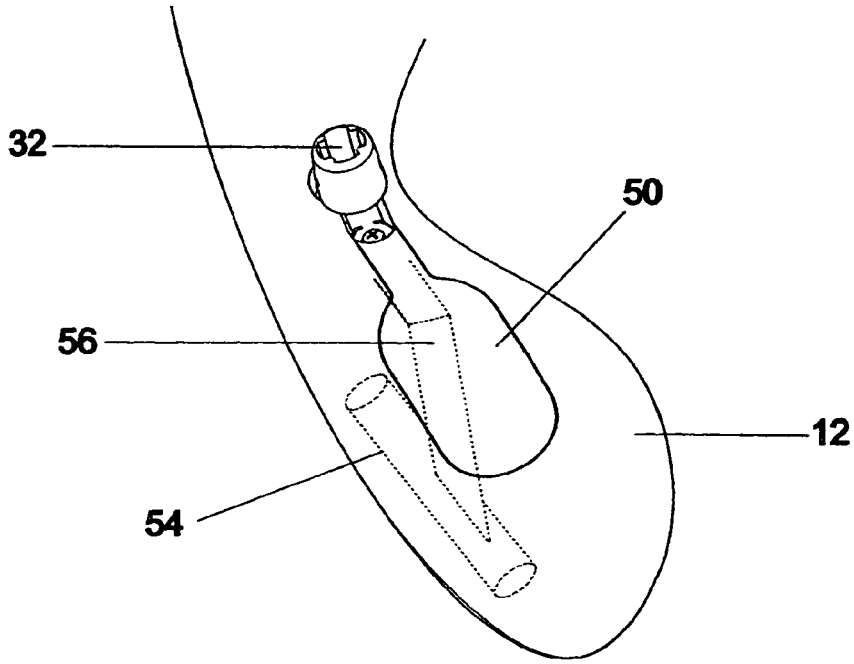
FIG. 11 shows the second end of the blade of FIGS. 9 and 10, with a counterweight within the blade.

In the further embodiment shown in FIGS. 9, 10 and 11, a single discrete mass or a plurality of masses may be inserted in cavity 48 covered by cover 50. Cavity 48 is extended in this embodiment to accommodate connection point 32 and teeter hinge 52, discussed in more detail in connection with FIGS. 12, 13 and 14 below.

Shown in ghosted outline in FIG. 11 is a single discrete mass 54 suspended within blade 12 by bracket 56.

Figure 12:
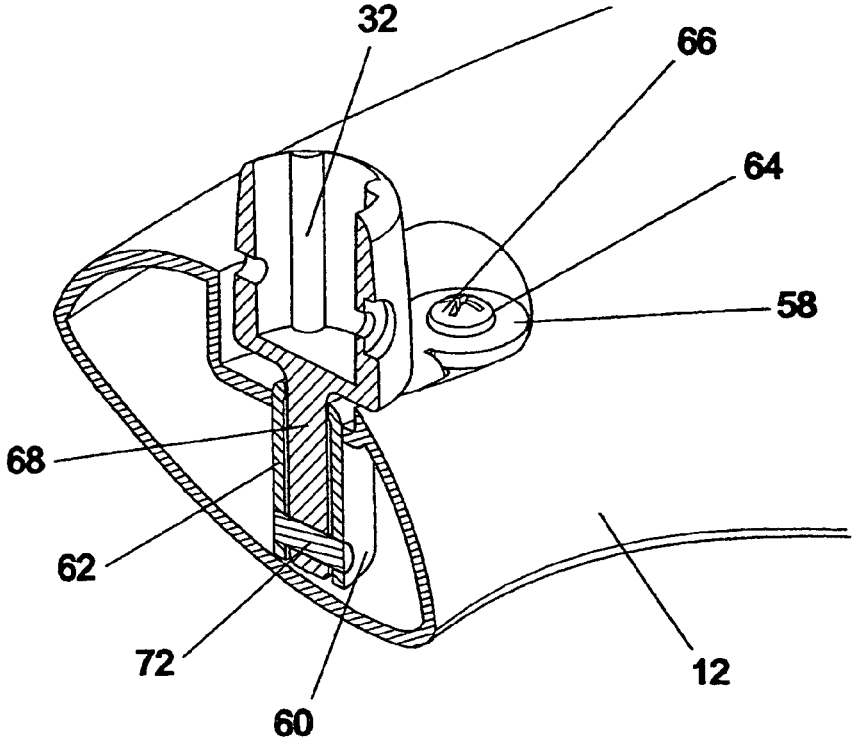
FIG. 12 is a partial cross-sectional view of the blade of FIGS. 9, 10 and 11 taken along the line A-A of FIG. 10.
Figure 13:
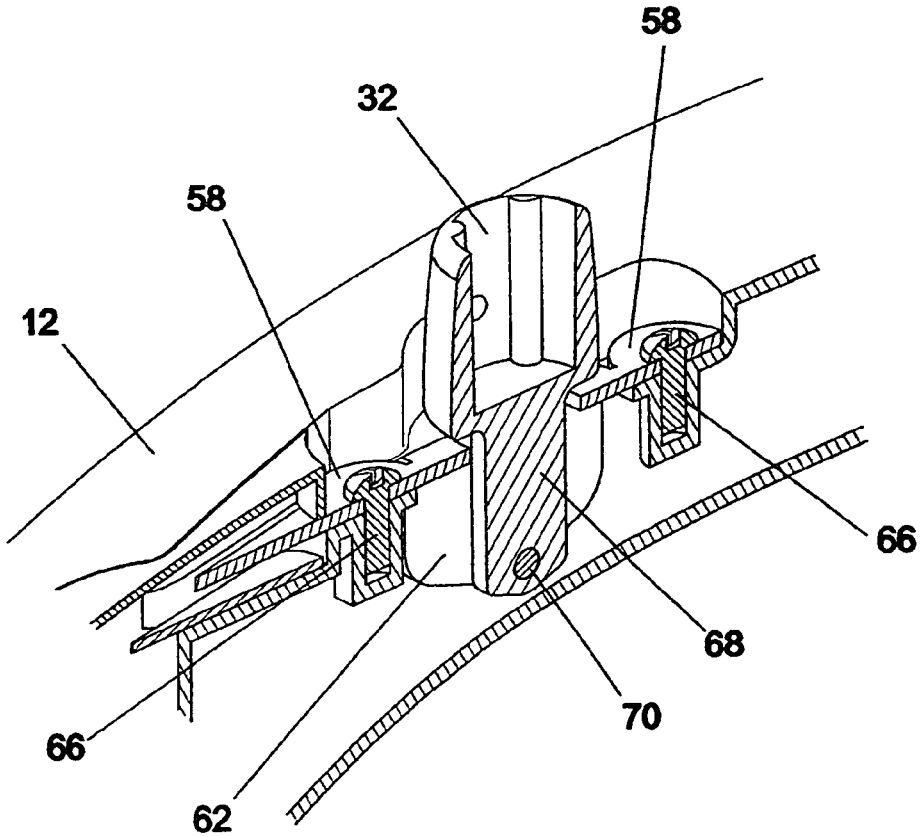
FIG. 13 shows cross-sectional detail of the blade taken along the line B-B of FIG. 10.
Figure 14:
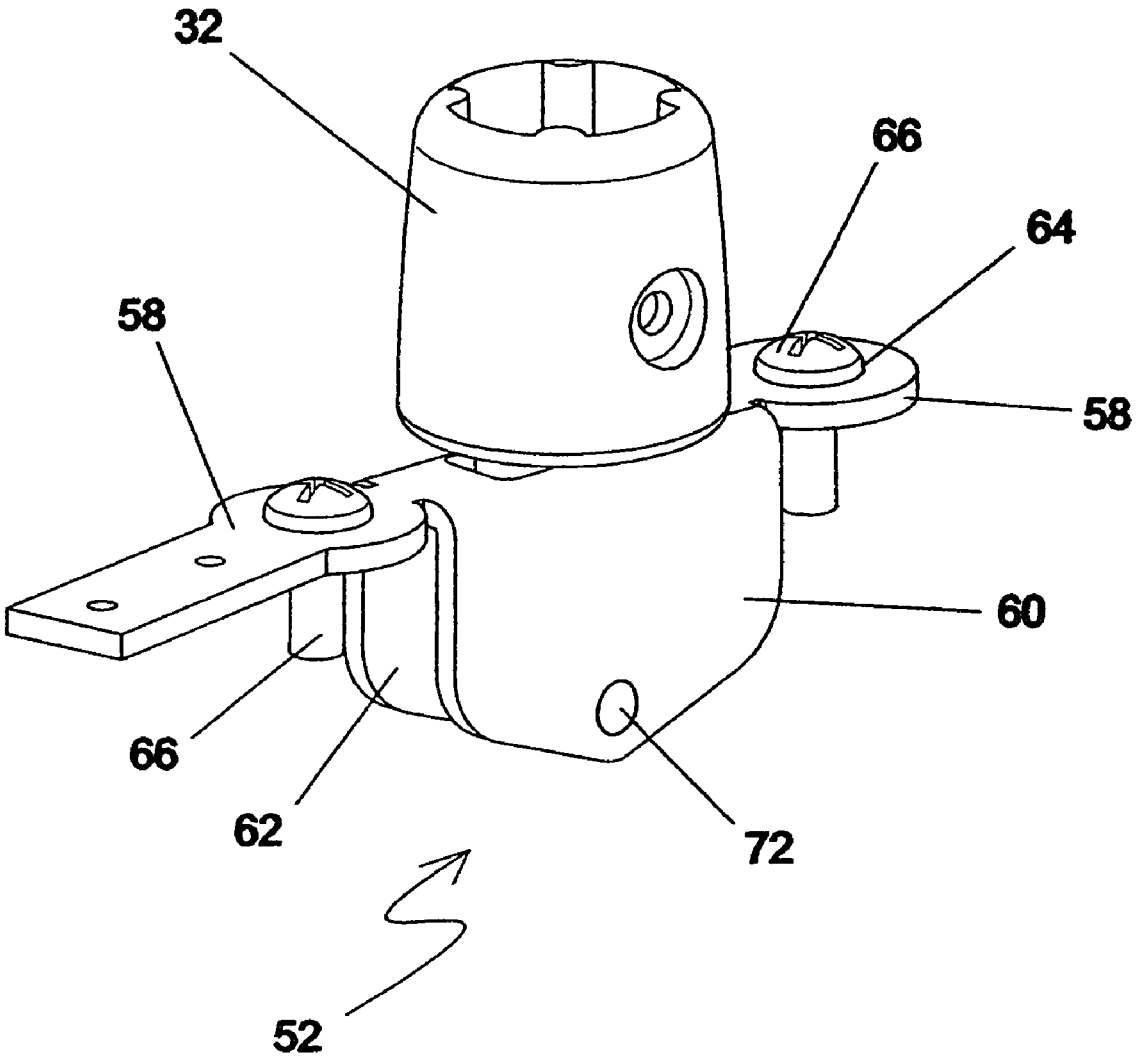
FIG. 14 shows the teeter hinge and connection point illustrated in cross-sectional view in FIG. 13.

Details of teeter hinge 52 can be seen in FIGS. 12, 13 and 14. Teeter hinge 52 can be applied to any of the embodiments illustrated herein in FIGS. 4, 5, 6, 7, 9, 10 and 11.

Teeter hinge 52 has cross bar 58 originally attached or integral with (as in this case) plates 60 and 62. Cross bar 58 includes screw hole apertures 64 into which are fitted screws 66 that serve to secure cross bar 58 to blade 12 (refer to FIG. 13).

Connection point 32, which connects blade 12 to shaft 18 (not shown), has tail 68. Aperture 70 in tail 68 receives pivot pin 72 to connect tail 68 pivotably to plates 60 and 62.

As can be seen from FIGS. 13 and 14, there is a small amount of clearance between the inner ends of cross bar 58 and tail 68, so that connection point 32 can pivot to a small extent around pivot pin 72.

Blade 12 and the location of the counterweights are designed so that the center of mass of blade 12 (when viewed in plan) is located approximately in the location of connection point 32 and drive shaft 18 (not shown). Also, when viewed in plan, the pivot axis is perpendicular to a line drawn from the axis of rotation of the balanced blade to the center of lift of the blade portion of the balanced blade. The pivot axis is also aligned with the horizontal plane. The tip of blade 12 is thus free to move in a vertical direction by rotating about the pivot, but is constrained to rotate only in the plane in which the aerodynamic lift force of the blade is acting, thus maintaining the correct angle of attach of the blade.

This is in contrast to conventional fans, where the blades are generally rigidly connected to the motor housing or drive shaft.

It will be appreciated that the aerodynamic center of blade 12, the point at which lift is deemed to act, will vary, depending on air speed of blade 12 and also on the pitch of blade 12. The aerodynamic force on blade 12 is composed of both lift from blade 12 and also of lift and drag from blade 12, including lift and drag from the part of blade 12 near second end 16. Optionally, the combined center of action of these forces is the point that is used to define the line to which the pivot axis is perpendicular. The aerodynamic forces involved are relatively small and consequently the calculation of the angle of the pivot axis may be represented by a range of values.

Because blade 12 is suspended at the center of mass on the pivot, blade 12 is free to find its own balance, the position where the center of mass lies on the vertical axis of rotation and the principal axes of inertia of the center of gravity of balanced blade 12 lie in the vertical and horizontal planes. It is believed that if blade 12 were rigidly mounted and were balanced such that the principal axes of inertia of the center of gravity were not in the horizontal/vertical planes, even though the center of gravity might be on the vertical axis, the centrifugal forces would not be balanced and rotation of the blade would shake the bearings of the motor.

When blade 12 is supported at the center of mass of the balanced blade and blade 12 is allowed to "self level" because of teeter hinge 52, it has been found that the mass of blade 12 does not impart unwanted centrifugal forces to shaft 18 that would cause blade 12 to run off-center or wobble, cause unwanted vibrations or wear within the motor and/or transmit undue stresses to the mechanism used to fasten the fan assembly to the ceiling.

Because the pivot is incorporated at the center of mass, blade 12 can rotate freely thereabout. The aerodynamic forces acting on blade 12 cause blade 12 to rotate until the aerodynamic forces are matched by the gravitational and centripetal forces acting on blade 12. Thus, at any given speed, first end 14 will rise until the position is found at which the aerodynamic forces and the gravitational and centripetal forces acting on blade 12 are in balance. Any bending moment on shaft 18 may thus be eliminated or minimized, and fan 10 may run smoothly with no or minimal out-of-balance forces being transmitted to shaft 18, etc.

The fan of the invention provides a worthwhile addition to fan technology, especially where ceiling fans are involved. The fan of the invention can be presented in a modern, streamlined form that can cause movement of a greater volume of air with less rotational speed.

While particular embodiments of the invention have been shown and described, numerous variations and alternative embodiments will occur to those skilled in the art. Accordingly, it is intended that the invention be limited in terms of the appended claims.

What is claimed is:

1. A fan blade comprising:

a first portion having a first end, a first leading edge, and a first trailing edge;

a second portion having a second end, a second leading edge, and a second trailing edge, the second end opposed to the first end; and at least one counterweight coupled to one of the first portion and the second portion, both the first and the second portions being adapted to provide aerodynamic lift, wherein the aerodynamic lift provided by the second portion at least partially balances the aerodynamic lift provided by the first portion, wherein some or all of the at least one counterweight is located along the first leading edge of the fan blade.

2. A fan blade comprising:

a first portion having a first end, a first leading edge, and a first trailing edge;

a second portion having a second end, a second leading edge, and a second trailing edge, the second end opposed to the first end; and at least one counterweight coupled to one of the first portion and the second portion, both the first and the second portions being adapted to provide aerodynamic lift, wherein the aerodynamic lift provided by the second portion at least partially balances the aerodynamic lift provided by the first portion, wherein some of the at least one counterweight is located along the first leading edge of the first portion and some of the at least one counter weight is located along the first trailing edge of the first portion.

3. A fan blade comprising:

a first portion having a first end;

a second portion having a second end, the second end opposed to the first end;

at least one counterweight coupled to one of the first portion and the second portion, both the first and the second portions adapted to provide aerodynamic lift;

a connection point located between the first end and the second end, the connection point for coupling to a shaft;

a variable pitch connector coupled to the connection point permitting angular movement relative to a shaft coupled thereto;

a shaft coupled to the variable pitch connector;

a fan motor coupled to the shaft for rotationally driving the shaft, wherein at any given speed of rotation, the first end will rise until a position is found at which the aerodynamic, gravitational and centripetal forces acting on the fan blade are balanced to minimize or eliminate any bending moment on the shaft; and a mounting plate coupled to the fan motor for selectively attaching to a ceiling.

* * * * *